US010975336B2

(12) United States Patent
Knorr et al.

(10) Patent No.: US 10,975,336 B2
(45) Date of Patent: Apr. 13, 2021

(54) AQUEOUS MULTIPHASE SURFACTANT FRAGRANCE COMPOSITION

(71) Applicant: Colgate-Palmolive Company, New York, NY (US)

(72) Inventors: Joseph Knorr, East Brunswick, NJ (US); Junhong Mao, Plainsboro, NJ (US); Alison Kugler, Morganville, NJ (US); Ammanuel Mehreteab, Yardley, PA (US); Andrei Potanin, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/158,750

(22) Filed: Oct. 12, 2018

(65) Prior Publication Data

US 2019/0040340 A1 Feb. 7, 2019

Related U.S. Application Data

(62) Division of application No. 14/401,814, filed as application No. PCT/US2012/038408 on May 17, 2012, now Pat. No. 10,106,763.

(51) Int. Cl.

| | |
|---|---|
| ***C11D 1/94*** | (2006.01) |
| ***C11D 3/50*** | (2006.01) |
| ***C11D 9/44*** | (2006.01) |
| ***C11D 17/04*** | (2006.01) |
| ***C11D 17/00*** | (2006.01) |

(52) U.S. Cl.

CPC ..... *C11D 3/50* (2013.01); *C11D 1/94* (2013.01); *C11D 9/44* (2013.01); *C11D 17/003* (2013.01); *C11D 17/0017* (2013.01); *C11D 17/0078* (2013.01); *C11D 17/04* (2013.01); *C11D 17/043* (2013.01); *C11D 17/045* (2013.01)

(58) Field of Classification Search

CPC .... C11D 1/29; C11D 1/90; C11D 9/44; C11D 1/94; C11D 17/0017; C11D 17/0021; C11D 17/0026

See application file for complete search history.

(56) References Cited

U.S. PATENT DOCUMENTS

| | | | | |
|---|---|---|---|---|
| 5,108,643 | A * | 4/1992 | Loth | C11D 17/0021 510/101 |
| 5,374,614 | A * | 12/1994 | Behan | A61K 8/062 512/3 |
| 5,929,019 | A | 7/1999 | Puvvada et al. | |
| 6,245,344 | B1 | 6/2001 | Thibiant et al. | |
| 6,288,015 | B1 | 9/2001 | Moeller et al. | |
| 8,470,762 | B2 | 6/2013 | Broze et al. | |
| 2003/0003069 | A1 | 1/2003 | Carson et al. | |
| 2004/0026535 | A1* | 2/2004 | Conway | C11D 17/041 239/433 |
| 2004/0057920 | A1 | 3/2004 | Focht et al. | |
| 2004/0092415 | A1 | 5/2004 | Focht et al. | |
| 2004/0223991 | A1 | 11/2004 | Wei et al. | |
| 2004/0235693 | A1 | 11/2004 | Wei et al. | |
| 2004/0248748 | A1 | 12/2004 | Wei et al. | |
| 2005/0192187 | A1 | 2/2005 | Wagner et al. | |
| 2005/0079193 | A1* | 4/2005 | Nieendick | A61K 8/442 424/401 |
| 2005/0100570 | A1 | 5/2005 | Wei et al. | |
| 2005/0143268 | A1 | 6/2005 | Midha et al. | |
| 2005/0143269 | A1 | 6/2005 | Wei et al. | |
| 2005/0227892 | A1* | 10/2005 | Shaukat | C11D 3/3947 510/302 |
| 2005/0238680 | A1 | 10/2005 | Stella et al. | |
| 2005/0239670 | A1 | 10/2005 | Stella et al. | |
| 2005/0276768 | A1 | 12/2005 | Wei et al. | |
| 2005/0276829 | A1 | 12/2005 | Stella et al. | |
| 2006/0018857 | A1* | 1/2006 | Behler | A61Q 5/00 424/70.13 |
| 2006/0078524 | A1 | 4/2006 | Midha et al. | |
| 2006/0078527 | A1 | 4/2006 | Midha et al. | |
| 2006/0079417 | A1 | 4/2006 | Wagner et al. | |
| 2006/0079418 | A1 | 4/2006 | Wagner et al. | |
| 2006/0079419 | A1 | 4/2006 | Wagner et al. | |
| 2006/0079420 | A1 | 4/2006 | Wagner et al. | |
| 2006/0079421 | A1 | 4/2006 | Wagner et al. | |
| 2006/0079422 | A1* | 4/2006 | Midha | A61K 8/8158 510/130 |
| 2006/0094628 | A1 | 5/2006 | Wei et al. | |
| 2006/0153790 | A1* | 7/2006 | Fonolla Moreno | A61K 8/03 424/70.12 |
| 2006/0210505 | A1 | 9/2006 | Clapp et al. | |
| 2006/0276357 | A1 | 12/2006 | Smith, III et al. | |
| 2007/0009472 | A1 | 1/2007 | Niebauer et al. | |
| 2007/0117729 | A1 | 5/2007 | Taylor et al. | |
| 2007/0141001 | A1 | 6/2007 | Clapp et al. | |

(Continued)

FOREIGN PATENT DOCUMENTS

| | | |
|---|---|---|
| CA | 2335039 | 12/2000 |
| DE | 19925518 | 12/2000 |

(Continued)

OTHER PUBLICATIONS

Corresponding Office Action from the Patent Office of the Russian Federation dated Mar. 11, 2016.

International Search Report and Written Opinion of the ISA, dated Jan. 31, 2013.

Kugler et al., 2012, "presentation: Reinventing Liquid Formulations Body Wash."

Mao, 2018, "Experimental data: A stability study," dated Jul. 22, 2018.

(Continued)

*Primary Examiner* — Charles I Boyer

(57) ABSTRACT

A multicomponent composition separating surfactant and fragrance into separate phases to increase the fragrance release from the composition.

12 Claims, No Drawings

(56) References Cited

U.S. PATENT DOCUMENTS

| | | | | |
|---|---|---|---|---|
| 2007/0155637 | A1 | 7/2007 | Smith, III et al. | |
| 2007/0248562 | A1 | 10/2007 | Berry et al. | |
| 2007/0280976 | A1 | 12/2007 | Taylor et al. | |
| 2007/0293411 | A1 | 12/2007 | Focht et al. | |
| 2008/0031845 | A1 | 2/2008 | Stella et al. | |
| 2008/0033058 | A1 | 2/2008 | Stella et al. | |
| 2008/0039353 | A1 | 2/2008 | Focht et al. | |
| 2008/0045428 | A1 | 2/2008 | Focht et al. | |
| 2008/0045429 | A1 | 2/2008 | Focht et al. | |
| 2008/0242573 | A1 | 10/2008 | Wei | |
| 2009/0170744 | A1* | 7/2009 | Meine | A61Q 19/00 510/302 |
| 2010/0216684 | A1 | 8/2010 | Ferguson | C11D 17/0039 510/337 |
| 2010/0234323 | A1* | 9/2010 | Holzl | A01N 37/04 514/63 |
| 2011/0186467 | A1* | 8/2011 | Denome | B65D 65/46 206/524.7 |
| 2011/0293539 | A1* | 12/2011 | Ibrahim | A61K 8/0208 424/49 |
| 2012/0015009 | A9* | 1/2012 | Taylor | A61Q 5/02 424/401 |
| 2013/0101531 | A1 | 4/2013 | Shick | A61K 8/068 424/59 |
| 2013/0302392 | A1* | 11/2013 | Mistry | C09K 15/00 424/401 |
| 2014/0274865 | A1* | 9/2014 | Restrepo | A61K 8/042 510/403 |

FOREIGN PATENT DOCUMENTS

| | | |
|---|---|---|
| EP | 1279726 | 1/2003 |
| EP | 1553162 | 7/2005 |
| RU | 2272613 | 3/2006 |
| RU | 2012118390 | 11/2013 |
| WO | 2005/017085 | 2/2005 |
| WO | 2006/088535 | 8/2006 |
| WO | 2010/014481 | 2/2010 |
| WO | 2011/075353 | 6/2011 |
| WO | 2011/075551 | 6/2011 |
| WO | 2011/133456 | 10/2011 |

OTHER PUBLICATIONS

Normand et al., 2008, "Modelling perfume deposition on fabric during a washing cycle: theoretical approach," Flavour and Fragrance Journal 23:49-57.

Zoller, ed., 2006, Handbook of Detergents Part D: Formulation, pp. 81-89.

* cited by examiner

AQUEOUS MULTIPHASE SURFACTANT FRAGRANCE COMPOSITION

FIELD OF THE INVENTION

The present invention relates to a multiphase composition with surfactant and fragrance at least partially separated in separate phases.

BACKGROUND OF THE INVENTION

Fragrance is an important component to consumers in consumer products. Fragrance is one of the most expensive ingredients in a composition. It is desired to deliver the fragrance as effectively as possible to minimize the amount of fragrance to minimize the cost. In surfactant containing cleansing compositions, a large portion of the fragrance can be solubilized by the surfactant and is not released during use of the composition. It would be desirable for a composition to deliver more fragrance so that the amount of fragrance can be reduced.

BRIEF SUMMARY OF THE INVENTION

A multicomponent composition comprising a first phase comprising at least one surfactant chosen from anionic surfactants, amphoteric surfactants, zwitterionic surfactants, cationic surfactants, and nonionic surfactants, wherein an amount of nonionic surfactant is less than 75% by weight of all surfactant in the first phase, and a second phase comprising fragrance, wherein the first phase comprises at least 75% by weight of all surfactant in the first phase and the second phase, and wherein the second phase comprises at least 75% by weight of all fragrance in the first phase and second phase.

A method of providing an increased fragrance release from a surfactant and fragrance containing composition comprising separating the surfactant and fragrance into a multicomponent composition.

Use of a multicomponent composition to increase fragrance delivery compared to a single component composition having the same amount of surfactant and fragrance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

A multicomponent composition comprising a first phase comprising at least one surfactant chosen from anionic surfactants, amphoteric surfactants, zwitterionic surfactants, cationic surfactants, and nonionic surfactants, wherein an amount of nonionic surfactant is less than 75% by weight of all surfactant in the first phase, and a second phase comprising fragrance, wherein the first phase comprises at least 75% by weight of all surfactant in the first phase and the second phase, and wherein the second phase comprises at least 75% by weight of all fragrance in the first phase and second phase. Optionally, additional phases can be present. The term composition includes all phases present.

The multiphase composition can separate the phases by containing each of the phases in separate chambers in a multichamber container that allows for simultaneous dispensing of the phases together. Alternatively, the phases can be in physical contact with each other and each are structured to have a yield stress that does not allow more than 50% by weight of each phase to mix with the other phase, optionally no more than 40%, no more than 30%, no more than 20%, no more than 10%, no more than 5%, no more than 1%, no more than 0.5%, no more than 0.1%, or no more than 0.001% by weight of each phase to mix with the other phase. The first phase and second phase can remain separated for at least 30 days, optionally at least 45 days, at least 60 days, at least 90 days, at least 180 days.

In certain embodiments, the yield stress in the first phase and the second phase is at least 0.001 Pa. In other embodiments, the yield stress is 0.001 to 100 Pa. Optionally, the yield stress is at least 0.0015, at least 0.01, at least 0.1, at least 0.5, at least 1, at least 2, at least 3, at least 4, at least 5, at least 10, or at least 20 up to 100 Pa. Optionally the yield stress is less than 90, less than 80, less than 70, less than 60, less than 50, less than 40, less than 30, less than 20, less than 10, less than 5, less than 1 to 0.001 Pa. Yield stress is calculated using the Herschel-Bulkley model by fitting the model to the flow curves obtained by steady-state shearing with shear rate ramped from 0.1 to 600 with 10 points per decade and 10 sec per point. Such measurements were performed on AR-G2 rheometer (TA Instruments) at 25° C., using concentric cylinder geometry.

In other embodiments, the first phase comprises at least 80% by weight of all surfactant in the first phase and the second phase, optionally, at least 85, at least 90, at least 95, or 100% by weight of all surfactant in the first and second phase. In other embodiments with additional phases, the first phase comprises at least 75% by weight of all surfactant in the composition, optionally at least 80% at least 85, at least 90, at least 95, or 100% by weight of all surfactant in the composition.

In other embodiments, the second phase comprises at least 80% by weight of all fragrance in the first phase and the second phase, optionally, at least 85, at least 90, at least 95, or 100% by weight of all fragrance in the first and second phase. In other embodiments with additional phases, wherein the second phase comprises at least 75% by weight of all fragrance in the composition, optionally at least 80% at least 85, at least 90, at least 95, or 100% by weight of all fragrance in the composition.

The weight ratio of the first phase to the second phase can be any desired ratio. In certain embodiments, the weight ratio of the first phase to the second phase is 99:1 to 1:99, optionally, 9:1 to 1:9, 8:2 to 2:8, 7:3 to 3:7, 6:4to 4:6, or 1:1.

In other embodiments, an amount of nonionic surfactant is less than 70% by weight of all surfactant in the first phase, optionally less than 60%, less than 50%, less than 40%, less than 30%, less than 20%, less than 10%, or 0% by weight of all surfactant in the first phase.

In certain embodiments, the total amount of surfactant in the composition is 0.5 to 95% by weight of the composition. In other embodiments, the total amount of surfactant in the composition is 0.5 up to 90, 85, 80, 75, 70, 65, 60, 55, 50, 45, 40, 35, 30, 25, 20, 15, 10, or 5% by weight of the composition. In other embodiments, the total amount of surfactant in the composition is 1 to 95, 5 to 95, 10 to 95, 15 to 95, or 20 to 95% by weight of the composition. In other embodiments, the total amount of surfactant in the composition is 1 to 50, 1 to 40, 1 to 30, 1 to 20, 1 to 15, 5 to 50, 5 to 40, 5 to 30, 5 to 20, 5 to 15, 10 to 50, 10 to 40, 10 to 30, or 10 to 20% by weight of the composition.

In certain embodiments, the total amount of fragrance in the composition is 0.01 to 10% by weight of the composition. In other embodiments, the total amount of fragrance in the composition is 0.01 up to 5, 4, 3, 2, or 1% by weight of the composition. In other embodiments, the total amount of fragrance is 0.05, 0.1, 0.5, 1, 2, 3, 4, or 5 up to 10% by weight of the composition. In other embodiments, the total amount of fragrance in the composition is 0.1 to 5, 0.1 to 4, 0.1 to 3, 0.1 to 2, 0.1 to 1, 0.5 to 5, 0.5 to 4, 0.5 to 3, 0.5 to 2, 0.5 to 1, 1 to 5, 1 to4, 1 to 3, or 1 to 2% by weight of the composition.

In certain embodiments, the composition can be an aqueous, liquid composition. In certain embodiments, the total amount of water in the composition can be 20 to 99% by weight of the composition, optionally 20 up to 95, 90, 85, 80, 75, 70, 65, 60, 55, 50, 45, 40, 35, or 30% by weight of the composition. In other embodiments, the total amount of water in the composition can be 25, 30, 35, 40, 45, 50, 55, 60, 65, 70, 75, 80, 85, 90, or 95 up to 99% by weight of the composition.

In certain embodiments, the composition can be formulated to be a personal care composition, a body wash, a shower gel, a liquid hand cleanser, a shampoo, a conditioner, a bar soap, a home care composition, a hard surface cleaner, a dish liquid, or a fabric conditioner.

The type of surfactant can be any combination of anionic, amphoteric, zwitterionic, cationic, or nonionic surfactant. In certain embodiments, the composition includes anionic surfactants and optionally amphoteric and/or zwitterionic surfactants.

The composition can be structured by any known structuring agent (such as by polymers, gums or celluloses) or by salt with a sufficient amount of surfactant.

The fragrance release from a single component composition containing surfactant and fragrance can be increased by separating the fragrance and surfactant into a multicomponent composition as described herein.

EXAMPLES

A control composition with 11.84 weight % total surfactant and 0.95 weight % fragrance is compared a dual phase composition A having all of the surfactant in one phase (Surfactant Phase A) and all of the fragrance in another phase (Fragrance Phase). The phases are each used at 50% by weight of the total composition. Also, a dual phase composition B with half the amount of surfactant is prepared (Surfactant Phase B) with all of the fragrance in another phase (Fragrance Phase). The compositions are listed below. The weight % is the weight % in the phase. The surfactant phase and the fragrance phase are each used at 50% by weight of the total composition.

| Ingredient | Surfactant Phase A Formula AI (wt. %) | Surfactant Phase B Formula AI (wt. %) | Fragrance Phase Formula AI (wt. %) | Control Formula AI (wt. %) |
|---|---|---|---|---|
| Sodium lauryl ether sulfate | 17.34 | 8.67 | 0 | 8.67 |
| Cocamidopropyl Betaine | 6.34 | 3.17 | 0 | 3.17 |
| Carbopol ™ Aqua SF-1 polymer | 2.68 | 2.68 | 2.68 | 2.68 |

-continued

| Ingredient | Surfactant Phase A Formula AI (wt. %) | Surfactant Phase B Formula AI (wt. %) | Fragrance Phase Formula AI (wt. %) | Control Formula AI (wt. %) |
|---|---|---|---|---|
| Polyquat 7 | 0 | 0 | 0.1 | 0 |
| NaOH | 0.65 | 0.65 | 0.65 | 0.65 |
| NaCl | 1 | 1 | 1 | 1 |
| EDTA | 0.08 | 0.08 | 0 | 0.08 |
| DMDM Hydantoin | 0.25 | 0.25 | 0 | 0.25 |
| Fragrance | 0 | 0 | 1.9 | 0.95 |
| Deionized Water | Q.S. | Q.S. | Q.S. | Q.S. |

A dynamic headspace analysis is conducted to evaluate fragrance performance of three different fragrance components, hexyl acetate, myrcenol, and nerol. Compositions A and B are prepared by adding 0.5 g of sample (0.25 g surfactant phase (A or B) and 0.25 g fragrance phase) into a gas chromatograph vial. Add 2 g of 40° C. deionized water. Incubate at 40° C. while shaking at 750 rpm. Six samples are prepared and kept mixing until analyzed. The first sample is analyzed at 30 seconds, and the subsequent samples are analyzed at 1 minute, 2 minutes, 5 minutes, 10 minutes, and 30 minutes. Sample 500 μl and inject into gas chromatograph column. The table below shows the intensity of each fragrance component in the head space above each composition at the different time intervals from 0.5 minutes to 30 minutes. Two replicates are prepared and the results are averaged.

| Hexyl Acetate | | | |
|---|---|---|---|
| Time | Concentration in head space × $10^6$ | | |
| (minutes) | Control | Composition A | Composition B |
| 0.5 | 19.51 | 37.5 | 35.12 |
| 1 | 24.95 | 31.93 | 36.14 |
| 2 | 27.59 | 26.06 | 33.95 |
| 5 | 26.78 | 24.33 | 38.33 |
| 10 | 23.28 | 22.16 | 32.92 |
| 30 | 12.4 | 12.77 | 23.55 |

| Myrcenol | | | |
|---|---|---|---|
| Time | Concentration in head space × $10^6$ | | |
| (minutes) | Control | Composition A | Composition B |
| 0.5 | 2.34 | 5.99 | 5.8 |
| 1 | 2.95 | 4.42 | 5.52 |
| 2 | 3.21 | 3.23 | 4.92 |
| 5 | 3.48 | 3.25 | 6.92 |
| 10 | 3.4 | 3.37 | 7.29 |
| 30 | 3.13 | 3.09 | 6.69 |

| Nerol | | | |
|---|---|---|---|
| Time | Concentration in head space × $10^6$ | | |
| (minutes) | Control | Composition A | Composition B |
| 0.5 | 0.14 | 0.43 | 0.4 |
| 1 | 0.16 | 0.28 | 0.41 |
| 2 | 0.19 | 0.19 | 0.42 |
| 5 | 0.21 | 0.2 | 0.44 |

-continued

| Nerol | | | |
|---|---|---|---|
| Time | Concentration in head space × $10^6$ | | |
| (minutes) | Control | Composition A | Composition B |
| 10 | 0.21 | 0.2 | 0.45 |
| 30 | 0.2 | 0.19 | 0.43 |

For each of the fragrances above, Composition A delivers a higher amount of the fragrance to the head space above the composition, which indicates a greater release of fragrance. The data beyond 2 minutes do not show any difference between the control and inventive composition because with continuous mixing, there is no longer two phases. Both the control and the test compositions are single phases after 2 minutes.

To evaluate fragrance release during use conditions, a panel of people apply the control composition to one forearm and an inventive composition to the other forearm and evaluate fragrance intensity of a scale of 0 (no fragrance odor) to 7 (strong fragrance odor). The compositions below are prepared similar to the compositions above. The procedure for washing is rinse forearm with 37.7° C. (100° F.) tap water. Wash one forearm with control composition and the other with inventive composition. Rinse, pat dry, and smell forearm. The results are below for comparisons between Control and Composition C and Control and Composition D, which are conducted separately, based on the average rating by all panelists. For Control vs. Composition C, there are 8 panelists. For Control vs. Composition D, there are 7 panelists.

| Ingredient | Surfactant Phase C Formula AI (wt. %) | Surfactant Phase D Formula AI (wt. %) | Fragrance Phase Formula AI (wt. %) | Control Formula AI (wt. %) |
|---|---|---|---|---|
| Sodium lauryl ether sulfate | 17.34 | 8.67 | 0 | 8.67 |
| Cocamidopropyl Betaine | 6.34 | 3.17 | 0 | 3.17 |
| Carbopol ™ Aqua SF-1 polymer | 2.68 | 2.5 | 3 | 2.5 |
| Polyquat 7 | 0 | 0 | 0 | 0 |
| NaOH | 0.65 | 0.65 | 0.65 | 0.65 |
| NaCl | 1 | 1 | 1 | 1 |
| EDTA | 0.08 | 0.06 | 0 | 0.06 |
| DMDM Hydantoin | 0.25 | 0 | 0 | 0 |
| Fragrance | 0 | 0 | 1.9 | 0.95 |
| Deionized Water | Q.S. | Q.S. | Q.S. | Q.S. |

| Time (min) | Control | Composition C | Control | Composition D |
|---|---|---|---|---|
| 0 | 4 | 5 | 4 | 5 |
| 10 | 2 | 4 | 3 | 5 |
| 30 | 1 | 3 | 2 | 4 |
| 60 | 1 | 3 | 2 | 4 |
| 180 | 1 | 2 | 1 | 3 |
| 300 | 1 | 1 | 0 | 1 |

As can be seen above, the inventive compositions provide a higher fragrance intensity over time compared to the control composition.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. A multiphase composition comprising a first phase comprising at least one surfactant chosen from anionic surfactants, amphoteric surfactants, zwitterionic surfactants, cationic surfactants, and nonionic surfactants, wherein an amount of nonionic surfactant is less than 75% by weight of all surfactant in the first phase, and a second phase comprising fragrance, wherein the first phase comprises at least 75% by weight of all surfactant in the first phase and the second phase, wherein the second phase comprises at least 75% by weight of all fragrance in the first phase and second phase, wherein the first phase and the second phase are aqueous phases, wherein a weight ratio of the first phase to the second phase is 8:2 to 2:8, wherein the first phase and the second phase are in physical contact with each other and each are structured by a structuring agent selected from polymers, gums and celluloses or by salt with a sufficient amount of surfactant, so as to have a yield stress that does not allow more than 50% by weight of each phase to mix with the other phase, and wherein the composition includes an anionic surfactant and an amphoteric or zwitterionic surfactant.

2. The multiphase composition of claim 1, wherein the first phase and the second phase each are structured to have a yield stress that does not allow more than 40% by weight of each phase to mix with the other phase, optionally no more than 30%, no more than 20%, no more than 10%, no more than 5%, no more than 1%, no more than 0.5%, no more than 0.1%, or no more than 0.001% by weight of each phase to mix with the other phase.

3. The multiphase composition of claim 2, wherein the yield stress in the first phase and the second phase is at least at least 0.001 Pa, optionally 0.001 to 100 Pa or at least 0.0015, at least 0.01, at least 0.1, at least 0.5, at least 1, at least 2, at least 3, at least 4, at least 5, at least 10, or at least 20 up to 100 Pa.

4. The multiphase composition of claim 2, wherein the first phase and second phase remain separated for at least 30 days, optionally at least 45 days, at least 60 days, at least 90 days, at least 180 days.

5. The multiphase composition of claim 1, wherein the first phase comprises at least 80% by weight of all surfactant in the first phase and the second phase, optionally, at least 85, at least 90, at least 95, or 100% by weight of all surfactant in the first and second phase.

6. The multiphase composition of claim 1, wherein the second phase comprises at least 80% by weight of all fragrance in the first phase and the second phase, optionally, at least 85, at least 90, at least 95, or 100% by weight of all fragrance in the first and second phase.

7. The multiphase composition of claim 1 further comprising at least one additional phase.

8. The multiphase composition of claim 1, wherein the first phase comprises at least 75% by weight of all surfactant in the composition, optionally at least 80%, at least 85, at least 90, at least 95, or 100% by weight of all surfactant in the composition.

9. The multiphase composition of claim 1, wherein the second phase comprises at least 75% by weight of all fragrance in the composition, optionally at least 80% at least 85, at least 90, at least 95, or 100% by weight of all fragrance in the composition.

10. The multiphase composition of claim 1, wherein the weight ratio of the first phase to the second phase is 7:3 to 3:7, 6:4 to 4:6, or 1:1.

11. The multiphase composition of claim 1, wherein the first phase comprises an anionic surfactant in an amount of from 8.67% to 17.34% by weight based on the total weight of the first phase, an amphoteric or zwitterionic surfactant in an amount of from 3.17% to 6.34% by weight based on the total weight of the first phase, optionally wherein the anionic surfactant is sodium lauryl ether sulphate and the amphoteric or zwitterionic surfactant is cocamidopropyl betaine (CAPB), and wherein an amount of the nonionic surfactant is less than 70% by weight of all surfactant in the first phase, optionally less than 60%, less than 50%, less than 40%, less than 30%, less than 20%, less than 10%, or 0% by weight of all surfactant in the first phase.

12. A method of providing an increased fragrance release from a surfactant and fragrance containing composition comprising separating the surfactant and fragrance into a multiphase composition according to claim 1.

* * * * *